United States Patent [19]

Kovalak, Jr.

[11] Patent Number: 4,817,317

[45] Date of Patent: Apr. 4, 1989

[54] COMPONENT SIGN SYSTEM

[75] Inventor: Judson L. Kovalak, Jr., Rockford, Mich.

[73] Assignee: SignComp, Inc., Comstock Park, Mich.

[21] Appl. No.: 947,689

[22] Filed: Dec. 30, 1986

[51] Int. Cl.[4] ..... G09F 17/00

[52] U.S. Cl. ..... 40/603; 40/549; 40/574

[58] Field of Search ..... 40/574, 603, 575, 615, 40/549, 611, 155, 152; 16/264, 355

[56] References Cited

U.S. PATENT DOCUMENTS

| | | | |
|---|---|---|---|
| 1,148,764 | 8/1915 | Faires | 160/393 |
| 1,521,167 | 12/1924 | Achterkirch et al. | 160/393 |
| 2,190,557 | 2/1940 | Connell | 40/152 |
| 3,538,634 | 11/1970 | Bloom | 40/549 |
| 3,848,349 | 11/1974 | Olsen | 40/574 |
| 3,863,372 | 2/1975 | Stilling | 40/549 |
| 3,978,905 | 4/1976 | Lama et al. | 160/378 |
| 3,982,345 | 9/1976 | Coleman | 40/603 |
| 4,145,828 | 3/1979 | Hillstrom | 40/156 |
| 4,169,327 | 2/1979 | Stilling | 40/549 |
| 4,213,493 | 7/1980 | Haworth | 160/351 |
| 4,265,039 | 5/1981 | Brooks | 40/603 |
| 4,267,657 | 5/1981 | Kloke | 40/574 |
| 4,317,302 | 3/1982 | Von De Linde | 40/549 |
| 4,430,819 | 2/1984 | Chandler | 40/564 |
| 4,452,000 | 6/1984 | Gandy | 40/574 |
| 4,516,343 | 5/1985 | Stilling | 40/574 |
| 4,542,605 | 5/1985 | Gandy | 40/574 |
| 4,547,987 | 10/1985 | Stilling | 40/574 |

FOREIGN PATENT DOCUMENTS

| | | | |
|---|---|---|---|
| 750111 | 1/1967 | Canada | 40/574 |
| 1110448 | 10/1981 | Canada | 40/574 |

OTHER PUBLICATIONS

Brochure Signpro Systems, entitled "Design Viewpoint".
Brochure entitled "4 Basic Signpro Extrusions".
Advertising Sheet entitled "Signpro Systems Frameless Retrofit".
Price List entitled "Signtech Inc., Nov. 1984".

*Primary Examiner*—Robert Peshock
*Assistant Examiner*—J. Hakomaki
*Attorney, Agent, or Firm*—Price, Heneveld, Cooper, DeWitt & Litton

[57] ABSTRACT

An illuminated sign structure is fabricated from a plurality of individual components. A main frame, box or housing includes top, bottom and side members which define an enclosure for a light source. The top member of the body defines a peripheral face flange which forms a semicircular hinge groove and an elongated, generally U-shaped drain channel. A face frame includes a top frame member having a horizontally extending hinge flange which terminates in a hinge bead. The bead is disposed within the hinge groove. A plurality of fasteners positioned through apertures in the hinge flange capture the hinge bead within the hinge groove. Either a rigid or flexible sheet signal face is supported on the face frame. A plurality of elongated tension rails disposed within tension channels defined by the face frame support the flexible sign face. Adjustable fasteners contact the tension rails and stretch the sign face over sign face lips defined by the face frame structure.

19 Claims, 4 Drawing Sheets

COMPONENT SIGN SYSTEM

BACKGROUND OF THE INVENTION

The present invention relates to sign structures and more particularly to commercial, display signs having a translucent sign face mounted on a box or central housing within which a lighting source may be provided.

Presently, various commercial signs are available for use in advertising at stores, malls and the like. Generally, these signs include a rectangular box supporting a lighting source such as one or more fluorescent tubes. The box includes a face formed from a translucent material. Information, advertising and such is printed on the sign face. The signs may be single or double sided. Single-sided signs are generally mounted directly on the wall of a building Double-sided signs are mounted on a support post or other structure.

Typically, such commercial signs are fabricated from aluminum extrusions. The signs may be provided in standard sizes or custom sizes merely by cutting standard extrusions and assembling the components to form the sign structure. Available systems are not readily adapted to either flexible face or rigid face constructions. In addition, available systems are relatively complex providing difficulties both in assembly and in general maintenance. Difficulties are presented in servicing the signs, such as when replacing the light or when replacing the sign face. Present systems suffer from relatively high cost, assembly and maintenance problems.

A need exists for a component sign system which has reduced complexity and which standardizes to a greater extent the individual components resulting in easier manufacture and easier adaptation to custom situations. A need further exists for a system which will accommodate a wide variety of different types and sizes of sign faces and which provides retrofit capabilities, ease of assembly, installation and repair.

SUMMARY OF THE INVENTION

In accordance with the present invention, the aforementioned needs are met. Essentially, a sign structure is provided including a face frame formed from individual components cut from an elongated extrusion. The face frame includes a top member defining a hinge flange and bead. The face frame accommodates both a flexible sign face and a rigid sign face. The face frame components cooperate with a housing, box or central filler frame which defines a hinge bead. Removable fasteners capture the hinge bead within the groove. The sign face frame is, therefore, pivoted or hinged to the central filler frame.

In narrower aspects of the invention, the individual top, bottom and side members of the face frame define a tension channel. Elongated tension rails each define a groove within which a flexible sign face is captured by a flexible bead or spline. The tension rails are positioned within the tension rail channels of the face frame members. Adjustable fasteners engage the tension rails to stretch the sign face over a sign face lip structure defined by the face frame. The individual components define a relatively weather-tight structure, provide for water drainage and permit ease of assembly and access to the interior of the sign for replacement of the sign face or for maintenance. The components of the system are readily adapted to use as a retrofit, for single or double-sided sign structures and accommodate both flexible sign faces and rigid plastic sign faces.

DETAILED DESCRIPTION OF THE PREFERRED EMBODIMENT

Figure 1:
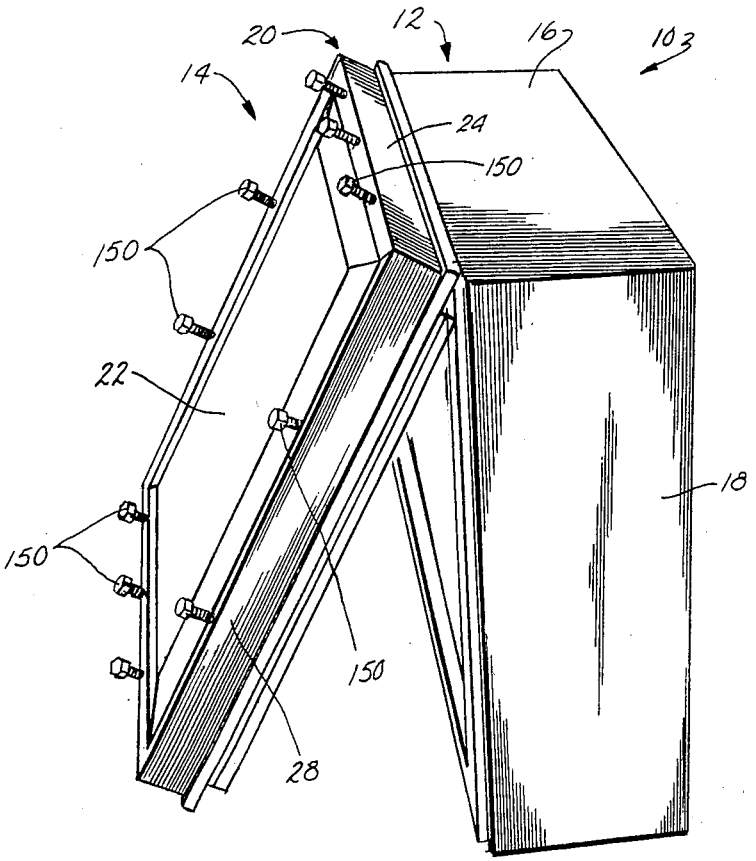
FIG. 1 is a side, perspective view of a sign structure in accordance with the present invention.
Figure 2:
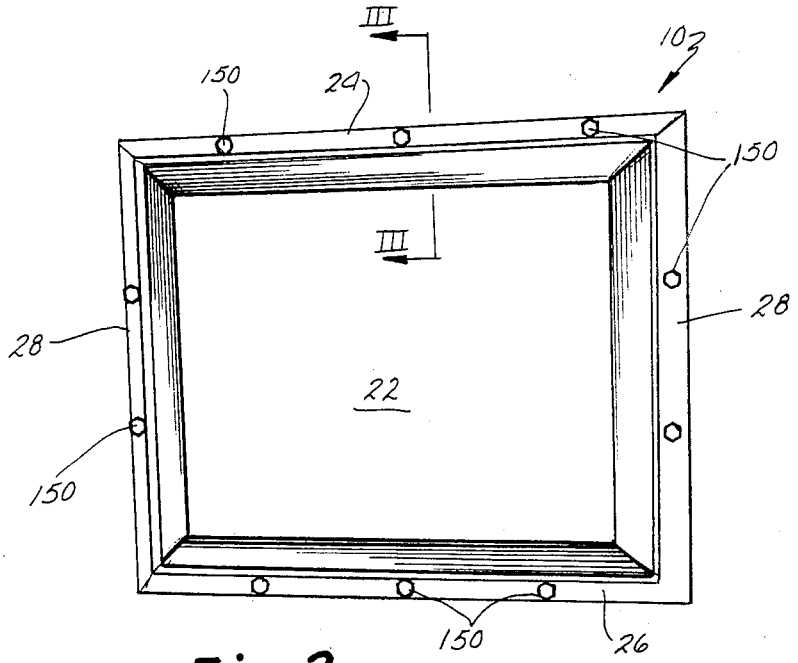
FIG. 2 is a front, elevational view of the sign structure.

A preferred embodiment of an illuminated display or commercial sign system in accordance with the present invention is illustrated in FIGS. 1 and 2 and generally designated by the numeral 10. The sign includes a main body, box or central filler frame 12 and a sign face structure 14. Central filler 12 includes top and bottom members 16 and side members 18. Face structure 14 includes a face frame 20 which supports a flexible sheet or sign face 22. Main body 12 is assembled from cut sections of a standard extrusion to form the top, bottom and side members. Face frame 20 includes a top member 24, a bottom member 26 and side members 28. Members 24, 26 and 28 are cut to the desired dimensions from a standard face frame extrusion. The body and face frame members are cut, their ends are mitered and then assembled. They may be joined by welding or with removable fasteners. Face frame structure 14 is pivoted to the main body 12 at top member 16, as explained in more detail below. The face structure may, therefore, be pivoted outwardly to provide access to the interior of the main frame 12 for maintenance and the like.

Figure 3:
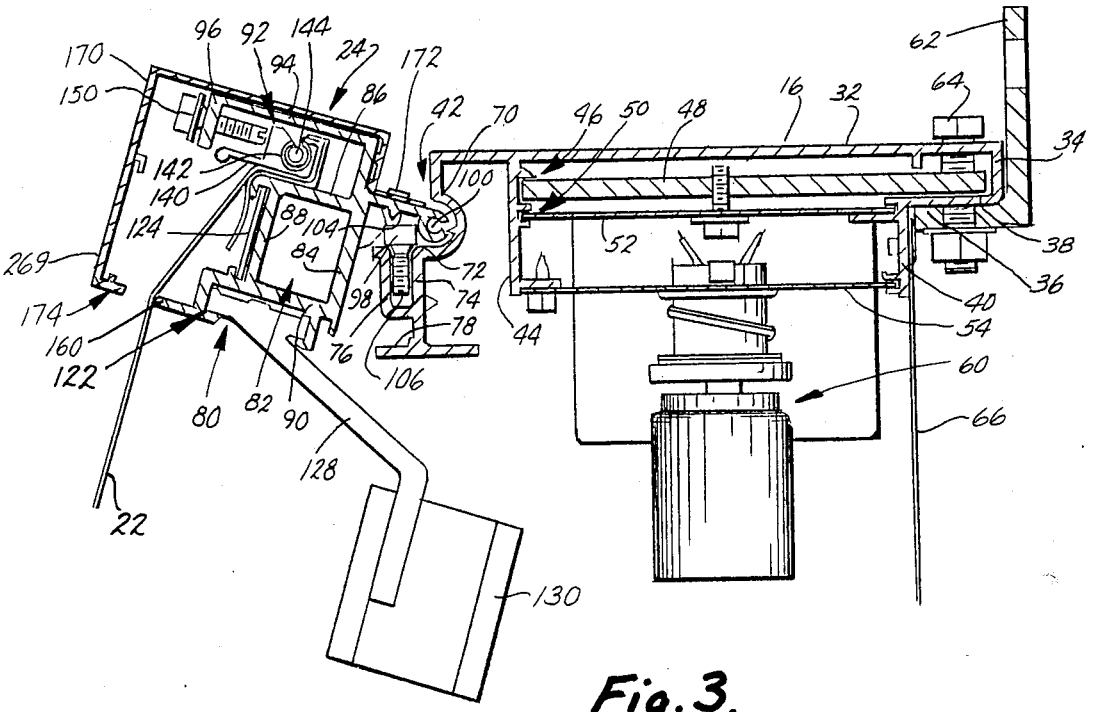
FIG. 3 is a cross-sectional view taken generally along line III—III of FIG. 2 illustrating a single-sided sign embodiment.

The configurations of the individual members of the body 12 and face structure 14 are illustrated in FIG. 3. As shown therein, embodiment 10 is a single-sided sign. Each of the members 16, 18 and 24, 26 and 28 are identical. As a result, only members 16 and 24 need be described in detail. Main body frame member 16 is fabricated as an aluminum extrusion. Member 16 includes an upper or outer wall 32, a rear wall 34, a generally L-shaped bottom wall portion 36 including a horizontal portion 38 and a vertical portion 40, and a front peripheral flange or wall 42. Member 16 is formed with an interior, vertical wall 44. Wall 44 defines a channel 46 which is adapted to receive a corner angle or key 48. Angle 48 is used to assemble the individual members. Member 16 also defines a groove or channel 50 to support a ballast bracket 52. A raceway cover 54 is supported between portions 40, 44. A fluorescent light assembly 60 is supported within main body 12. Body 12 is a single-sided sign face. A plurality of mounting brackets 62 are secured to the front of a building. Main frame 12 is secured to brackets 62 by suitable fasteners 64. A plate or cover 66 closes the back of the box.

Peripheral flange 42 of each of the individual members of frame 12 defines an elongated, semicircular-shaped hinge groove 70. Groove 70 includes a lower edge 72. Formed adjacent lower edge 72 is an elongated water drainage channel 74. Channel 74 includes a front wall or flange 76. Joined to a lower edge of flange 42 is an integral horizontal stop flange 78. An inner surface of face frame 20 abuts against stop flange 78 when such frame is in the closed position.

Each face frame member is an elongated extrusion 80. Extrusion 80 includes a central box-like structure 82 having a rear wall 84, a top wall 86, a front wall 88 and a bottom wall 90. Extrusion 80 further defines a tension rail channel 92. Channel 92 is bounded by an upper flange 94 and a fastener or adjustment flange 96. Extending perpendicular to rear wall 84 is a hinge flange 98. Hinge flange 98 terminates in an elongated, integral, hinge bead 100. Bead 100 is generally C-shaped in cross section and dimensioned to be received within hinge groove 70 defined by peripheral flange 42.

Figure 8:
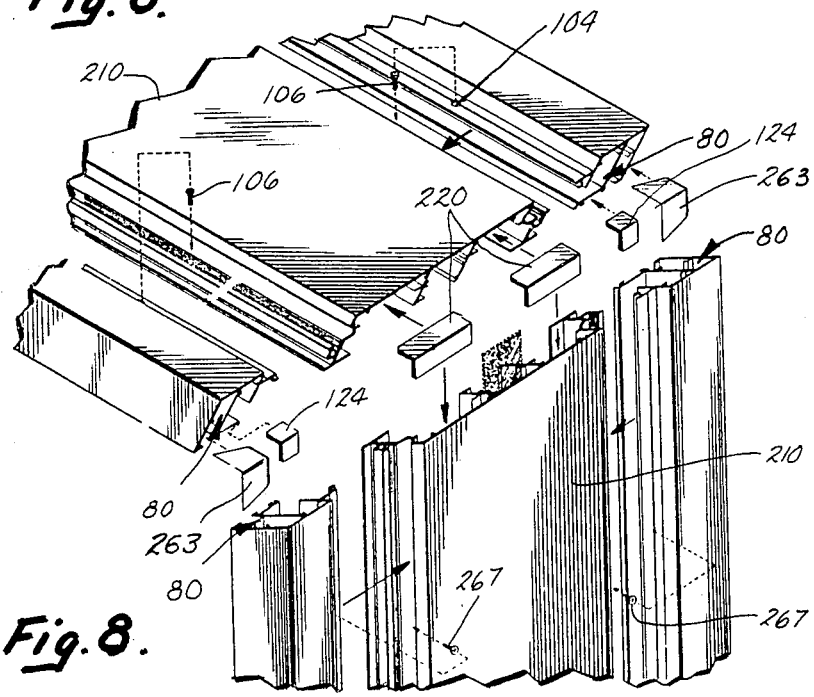
FIG. 8 is an exploded, fragmentary, perspective view illustrating the assembly of components of the sign structure in accordance with the present invention.

Flange 98 is formed with a plurality of longitudinally spaced apertures 104 (FIG. 8). Member 24 is positioned with hinge bead 100 within hinge groove 70. Allen head type fasteners or hinge screws 106 are positioned through apertures 104 and threaded into channel 74. As seen in FIG. 3, fasteners 106 capture hinge bead 100 within hinge groove 70 defined by the main body 12.

Face frame extrusion 80 further defines a corner key channel 120 and a compression brace channel 122. A corner key 124 is received within channel 120 to assemble the individual members of the face frame structure. A compression brace 128, as is known in the art, is slidably positioned within channel 122. Braces 128 are secured to both the upper and bottom members 24, 26. Braces 128 are connected by a compression beam 130. The braces and beam provide rigidity to the face frame structure.

A flexible sign face 22 is secured to members 24, 26 and 28. Sign face 22 has its edges disposed within elongated continuous tension rails 140. Rails 140 define semicircular grooves 142. Sign face 22 is held within grooves 142 of each channel 140 by a flexible spline or bead 144. Sign face 22 is tensioned or adjusted on face frame structure 20 by tension screws 150. As seen in FIGS. 1, 2 and 3, screws 150 are threaded through a flange 96 which overlies the tension channel. The screws contact elongated tension rail 140. The flexible sign face 22 is stretched over a lip or bead 160 defined by each face frame member. Face frame structure 20 of the FIG. 3 embodiment includes a generally L-shaped face cover 170. Cover 170 is secured to the hinge flange by suitable fasteners or sheet metal screws 172. Cover 170 in conjunction with the face frame extrusion defines a slot 174 through which sign face 22 extends.

Figure 6:
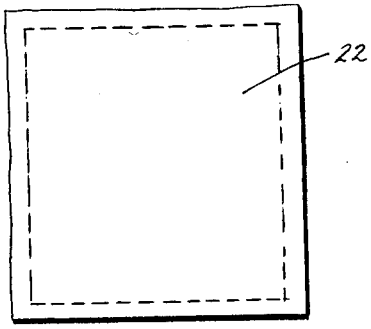
FIG. 6 is a plan view of a flexible sign face.
Figure 7:
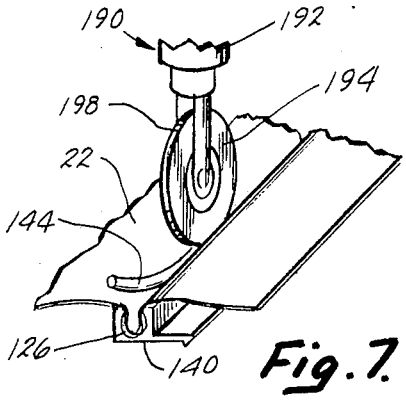
FIG. 7 is a fragmentary, perspective view showing the manner of attachment of a flexible sign face to a tension rail in accordance with the present invention.

Assembly of the flexible sign face 22 and tension rails 140 is illustrated in FIGS. 6 and 7. Flexible face material 22 is positioned with the printed material face side down. A spline or flex bead tool 190, which includes a handle 192 and a wheel 194, is used to secure sign face 22 to tension rail 140. As illustrated in FIG. 7, the sign face is positioned over the spline groove of the tension rail. Spline 144 is forced into groove 142 to capture the sign face within the rail groove by rolling wheel 194 of tool 190 there along. Wheel 194 includes a concave groove 198 which conforms to the outer surface of bead or spline 144. Tool 190 and spline 144 are similar to the spine tools and spline employed to mount screen material on an aluminum frame.

Figure 4:
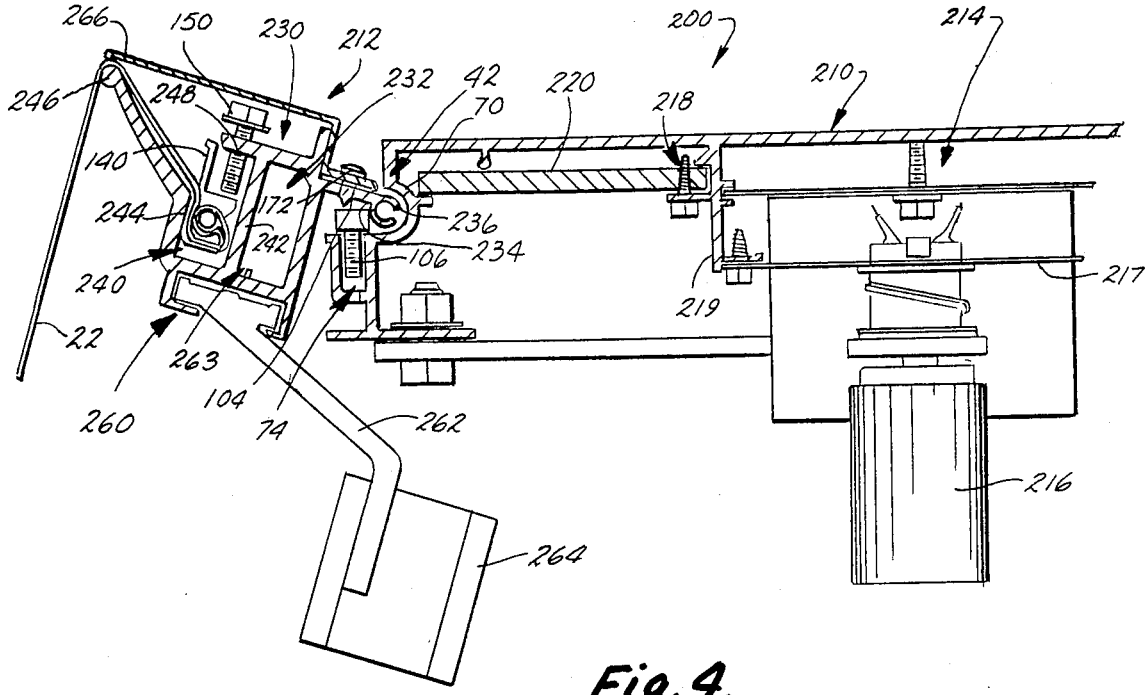
FIG. 4 is a cross-sectional view of an alternative embodiment.

FIG. 4 illustrates an alternative embodiment of the present invention. The embodiment of FIG. 4 is generally designated by the numeral 200. Embodiment 200 includes a main frame or body defined by members 210 and a face frame 212. Body members 210 are similar to body members 16. Each member 210 is an aluminum extrusion which defines a central raceway 214. A light assembly 216 is supported from a cover 217 joined to intermediate wall 219. Member 210 has a greater width dimension than member 16 and defines a channel 218 for an angle corner key 220. As with embodiment 16, member 210 includes a peripheral flange 42 defining a hinge groove 70 and an elongated channel 74. Face frame 212 is a bleed frame. The sign face 22 bleeds to the peripheral edge of the frame. The sign face is not "framed" by the supporting structure.

As shown in FIG. 4, face frame 212 includes extrusions or members 230. Each member 230 defines a central box-like portion 232 joined to an integral hinge flange 234. Hinge flange 234 terminates in a hinge bead 236 which is dimensioned to be received within hinge groove 70. Flange 234 is formed with a plurality of apertures 104 through which hinge screws 106 may be positioned and threaded into channel 74 to retain the hinge bead within the hinge groove.

Member 230 defines a tension rail channel 240 positioned in a vertical orientation as opposed to the horizontal orientation of the embodiment of FIG. 3. Channel 240 includes a sidewall 242 and a sidewall 244. Wall 244 extends upwardly and outwardly to define a bleed lip 246. Flexible sign face 22 is attached to tension rails 140. Rails 140 are positioned within their respective channels. Sign face 22 is stretched up and around or over bleed lip 246. Tension fasteners 150 extending through tension flange 248 position the rails within their respective channels. Member 230 also defines a compression brace channel 260 for a compression brace 262 and a corner angle channel 263. As in the previous embodiment, braces 262 held by the upper and lower frame members are connected by a compression beam 264. A bleed cover 266 covers the tension structure and is secured to the hinge flange by suitable fasteners 172.

As seen in FIG. 8, body members 210 are double-sided and symmetrical along a longitudinal centerline. Members 210 have peripheral flanges on each side to form a double-sided sign. As shown in FIG. 8, the top, bottom and side members 210 are cut from standard extrusions and their ends mitered. The ends are positioned adjacent each other and keys 220 are used to assemble these ends to form the main box or frame. Light assembly 216 is supported within the main box, as illustrated in FIG. 4. FIG. 8 shows assembly of the face frame of the embodiment of FIG. 3. Members 80 are cut and assembled with keys 124. Each face cover 170 defines an angle channel 269 (FIG. 3). Angle keys 263 are positioned within respective ones of the channels to assemble these members. The face frame is then positioned on the central box or main frame. Hinge screws 106 are inserted through apertures 104 and threaded into the drain channels defined by the main body frames. Sheet metal screws 267 secure the face frame to the main body. In order to gain access to the interior of the central box, screws 267 are removed from the side members and bottom member. The entire face frame is pivoted outwardly on the hinge bead disposed within the hinge grooves 70 of the top member of the main body or frame.

Figure 5:
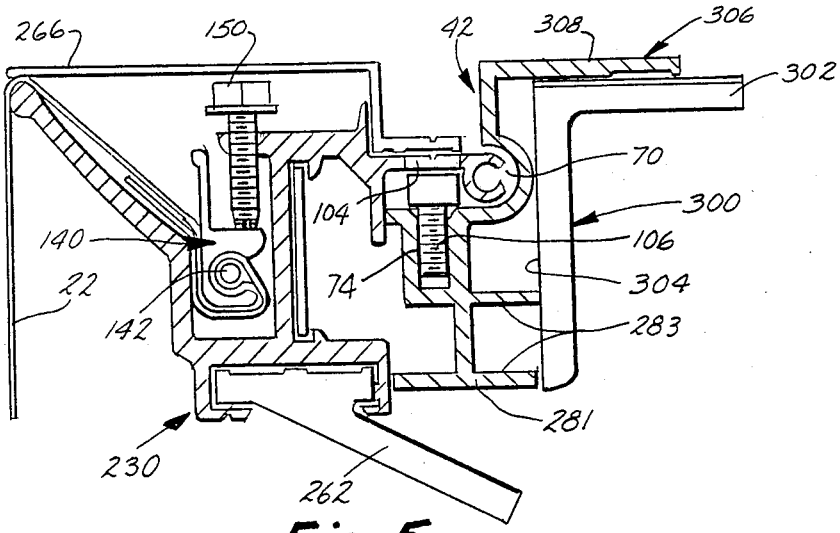
FIG. 5 is a fragmentary, cross-sectional view of an alternative, retrofit structure incorporating the present invention.

FIG. 5 illustrates an alternative embodiment of the present invention which provides a pivoted face frame as a retrofit for an existing sign cabinet. An existing cabinet 300 defines a top surface 302 and a front face or surface 304. Retrofit extrusions 306 each include an upper flange 308 and a peripheral flange 42. Flange 42 is identical to flange 42 of the embodiments of FIGS. 3 and 4. Flange 42 of the embodiment of FIG. 5 defines elongated drainage channel 74 and hinge groove 70. Joined to flange 42 is a stop flange 281 and pivoting flanges 283.

Retrofit members 306 are joined to define a retrofit frame which is positioned on cabinet 300. The frame is secured by suitable fasteners passing through upper flange 308. Members 306 support the face frames as in the previous embodiments.

Figure 9:
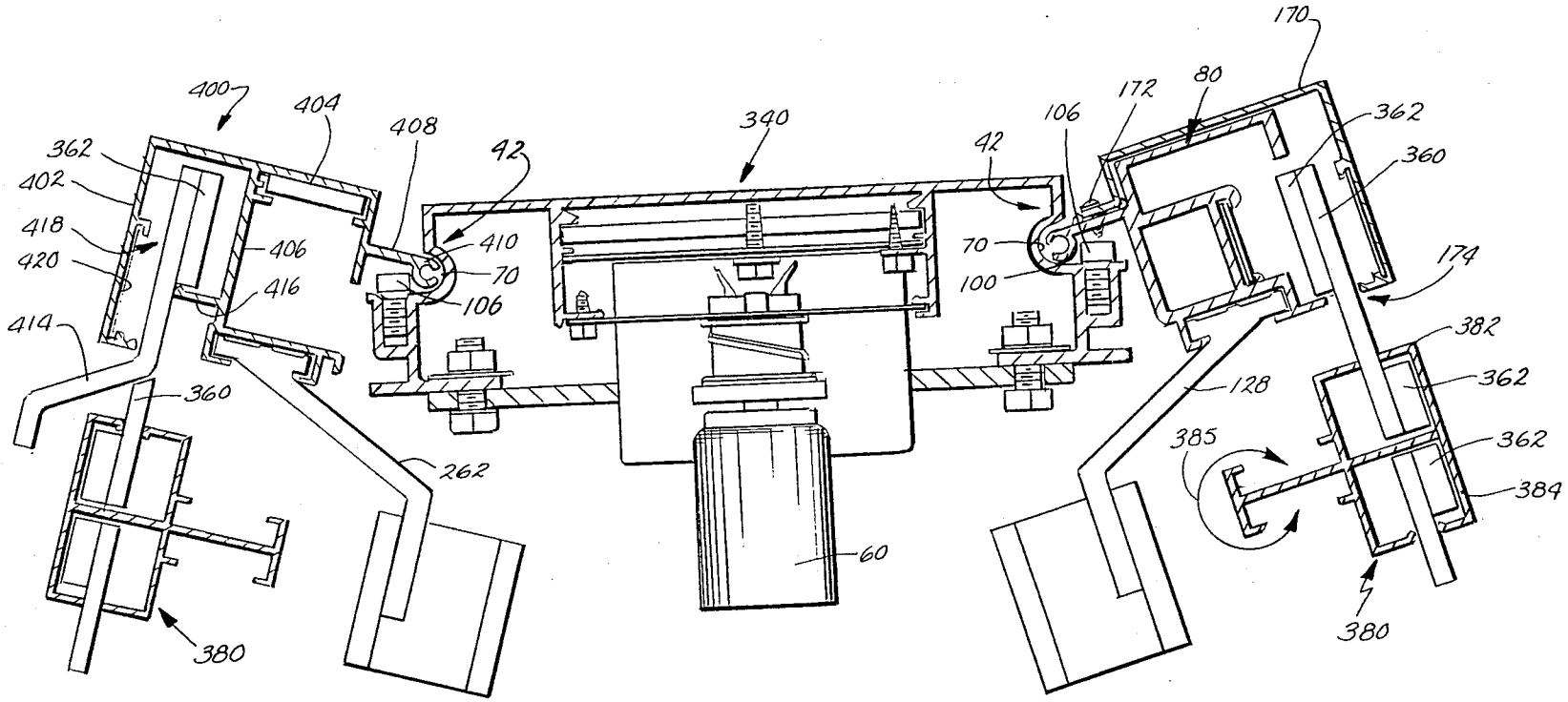
FIG. 9 is a fragmentary, cross-sectional view of an alternative embodiment of the sign structure in accordance with the present invention employing rigid sign faces.

FIG. 9 illustrates embodiments of the present invention adapted to support a rigid plastic sign face. As shown, the sign includes a central box formed from a body member 340. Member 340 is substantially the same as the embodiment of FIG. 3 except that it includes a pair of peripheral flanges 42. The right-hand side of FIG. 9 illustrates a face frame made up of the same components as the face frame of the embodiment of FIG. 3. Members 80 can also support a rigid sign face 360. Sign face 360 is generally rectangular and includes a support strip 362 which is secured thereto along a peripheral edge thereof.

In assembling the rigid sign face structure of FIG. 9, the top and bottom members are joined to one side frame member. The rigid sign face 360 is then slid into slots 174 defined by the face frame members and covers 170. The remaining face frame member is then joined to the assembly.

A sign divider extrusion 380 may also be included in the sign system of FIG. 9. The divider includes upper and lower box sections 382, 384. The box sections define slots 386 for receipt of separate sign faces 360. Divider 380 also defines compression brace channels 385. With rigid face signs, it is common for one sign box to support individual sign faces 360 to identify the individual merchants at the particular location. Once the sign is assembled, it is very easy to change the sign faces by merely removing one side member of the face frame. The old sign may be slipped out and the new sign slipped in and the system reassembled.

FIG. 9 further shows another extrusion configuration for the face frame which incorporates the hinge arrangement of the present invention. This alternative embodiment is designated 400. Extrusion 400 includes a front face or flange 402, a top face or flange 404, an intermediate flange or sidewall 406 and a hinge flange 408. Flange 408 terminates in a hinge bead 410 dimensioned to be received within hinge groove 70. Extrusion 400 supports only rigid sign faces 360 or 414. Sign face 414 is a convex sign face. Formed integral with intermediate wall 406 is a sign face support flange 416. Front flange 404, flange 406 and flange 416 define a slot within which either of the rigid sign faces 360, 414 may be positioned. Extrusion 400 also defines a key channel 418 adapted to receive angle keys 420 to assemble the individual components.

The hinge structure in accordance with the present invention is of substantially reduced complexity from that heretofore employed. This structure is readily incorporated into the various designs of signs presently desired including those shown in the embodiments of FIGS. 3, 4 and 9. The hinge structure is readily adapted to a retrofit arrangement, as illustrated in FIG. 5. The various extrusion configurations are standardized to thereby reduce the cost of manufacture. The assembly steps are identical regardless of the type of signage the customer desires. With the present invention, the many small parts of complex systems heretofore employed are avoided. Maintenance, repair or change of the sign face is more easily accomplished. The tension rail and spline arrangement employed with the flexible sign faces in accordance with the present invention insures that the sign face is evenly and accurately tensioned across the face frame. Difficulties encountered with assembly of prior systems are eliminated. Skilled labor and special training are no longer necessary.

In view of the foregoing description, those of ordinary skill in the art ma envision various modifications which would not depart from the inventive concepts disclosed herein. It is therefore expressly intended that the above description should be considered as only that of the preferred embodiments. The true spirit and scope of the present invention may be determined by reference to the appended claims.

The embodiments of the invention in which an exclusive property or privilege is claimed are defined as follows.

1. A component display sign comprising:

a generally rectangular main frame including a plurality of joined body frame members, each body frame member including an outer wall and a configured peripheral face flange extending generally perpendicular to said outer wall, said peripheral face flange of each body frame member defining an elongated, generally semicircular, outwardly opening hinge groove and an elongated drain channel adjacent said elongated hinge groove, said hinge groove defining a lower edge and said drain channel being integral with and extending along said lower edge;

a generally rectangular face frame including a plurality of joined face frame members, each face frame member including an elongated hinge flange having an integral hinge bead, said integral hinge bead being disposed within one of said hinge grooves and wherein each of said hinge flanges defines a plurality of spaced apertures overlying one of said elongated drain channels; and a plurality of hinge fasteners, each fastener positioned through an aperture of one of said face frame members and into a drain channel of one of said body frame members to capture said hinge bead within said hinge groove.

2. A component display sign as defined by claim 1 wherein each of said body frame members and said face frame members are integrally extruded as one-piece members.

3. A component display sign as defined in claim 2 wherein said face frame members each define an elongated tension channel.

4. A component display sign as defined by claim 3 further including:

a flexible sign face;

a plurality of elongated tension rails, each of said elongated tension rails being disposed within one of said elongated tension channels, and each of said elongated tension rails defining a sign face groove;

a plurality of flexible splines retaining peripheral edges of said sign face within said sign face grooves of said elongated tension rails; and tension adjustment means on said face frame members and engaging said elongated tension rails for shifting said rails within said elongated tension channels and tensioning said flexible sign face.

5. A component display sign as defined by claim 4 wherein said face frame members each define a tension flange overlying said tension channel.

6. A component display sign as defined by claim 5 wherein said tension adjustment means comprises a plurality of fasteners threaded through said tension flanges and engaging said tension rails.

7. A component display sign as defined by claim 6 wherein said face frame members each define a sign face lip extending parallel to said tension channel in a horizontal plane.

8. A component display sign as defined by claim 7 further including a plurality of face covers, each face cover being secured to one of said face frame members.

9. A component display sign as defined by claim 8 wherein each of said face frame members defines a compression brace channel and said sign further includes a compression beam extending between and connected to brace channels of opposed face frame members.

10. A component display sign as defined by claim 9 wherein each of said face frame members defines an angle key channel and said sign further includes a plurality of angle keys disposed within said angle key channels to join the face frame members together.

11. A component display sign as defined by claim 8 wherein said body frame members define a retrofit flange extending from and joined to said peripheral face so that said main frame is adapted to be mounted on an existing sign cabinet.

12. A component display sign as defined by claim 6 wherein said face frame members each define a bleed lip extending at an acute angle with respect to said tension channel.

13. A component display sign as defined by claim 12 further including a plurality of face covers, each face cover being secured to one of said face frame members.

14. A component display sign as defined by claim 2 wherein each of said face frame members defines a compression brace channel and said sign further includes a compression beam extending between and connected to brace channels of opposed face frame members.

15. A component display sign as defined by claim 14 wherein each of said face frame members defines an angle key channel and said sign further includes a plurality of angle keys disposed within said angle key channels to join the face frame members together.

16. A component display sign as defined by claim 2 wherein each of said face frame members defines an outwardly extending lip and said sign further includes a plurality of face covers each joined to one of said face frame members, each of said covers including an edge adjacent to and spaced from said lip to define a slot.

17. A component display sign as defined by claim 16 further including a rigid sign face disposed within said slots defined by said covers and said face frame member lips.

18. A component display sign as defined by claim 17 wherein said body frame members define a retrofit flange extending from and joined to said peripheral face so that said main frame is adapted to be mounted on an existing sign cabinet.

19. A component display sign as defined by claim 1 wherein said body frame members define a retrofit flange extending from and joined to said peripheral face so that said main frame is adapted to be mounted on an existing sign cabinet.

* * * * *